US006740329B2

(12) United States Patent
Bret et al.

(10) Patent No.: US 6,740,329 B2
(45) Date of Patent: May 25, 2004

(54) PROCESS FOR APPLYING A SOFTENING OR EMOLLIENT LOTION TO A PAPER PRODUCT AND PAPER PRODUCT OBTAINED ACCORDING TO THIS PROCESS

(75) Inventors: Bruno Bret, Colmar (FR); Jean-Francois Leboeuf, Horbourgwihr (FR)

(73) Assignee: Georgia-Pacific France, Kunheim (FR)

( * ) Notice: Subject to any disclaimer, the term of this patent is extended or adjusted under 35 U.S.C. 154(b) by 0 days.

(21) Appl. No.: 09/729,224

(22) Filed: Dec. 5, 2000

(65) Prior Publication Data

US 2001/0006676 A1 Jul. 5, 2001

(30) Foreign Application Priority Data

Dec. 10, 1999 (EP) ..... 99403111

(51) Int. Cl.[7] ..... A01N 25/34; A61K 7/00; D21H 23/00

(52) U.S. Cl. ..... 424/402; 424/400; 424/401; 162/158; 162/179

(58) Field of Search ..... 424/401, 402, 424/400, 404, 405; 162/158, 179

(56) References Cited

U.S. PATENT DOCUMENTS 5,705,164 A * 1/1998 Mackey et al. ..... 424/400

FOREIGN PATENT DOCUMENTS

| | | | |
|---|---|---|---|
| WO | WO 97/30216 | * | 8/1997 |
| WO | WO 97/30217 | * | 8/1997 |
| WO | WO 99/16974 | | 4/1999 |
| WO | WO 99/19081 | * | 4/1999 |

* cited by examiner

*Primary Examiner*—Thurman K. Page
*Assistant Examiner*—Marina Lamm
(74) *Attorney, Agent, or Firm*—Finnegan, Henderson, Farabow, Garrett & Dunner LLP

(57) ABSTRACT

The invention provides a process for depositing, at room temperature, a softening lotion on an absorbent paper product, especially cellulose wadding, which lotion is a liquid at room temperature and is of the type comprising one or more emollient active substances as a dispersion or as an emulsion in a volatile liquid vehicle, especially in water, characterized in that it consists in spraying the lotion by means of a stream of gas under pressure so as to remove at least part of the volatile liquid vehicle in order to form and spray fine droplets of lotion, having a low proportion of volatile liquid vehicle, which are deposited on at least one face of the paper product.

7 Claims, 1 Drawing Sheet

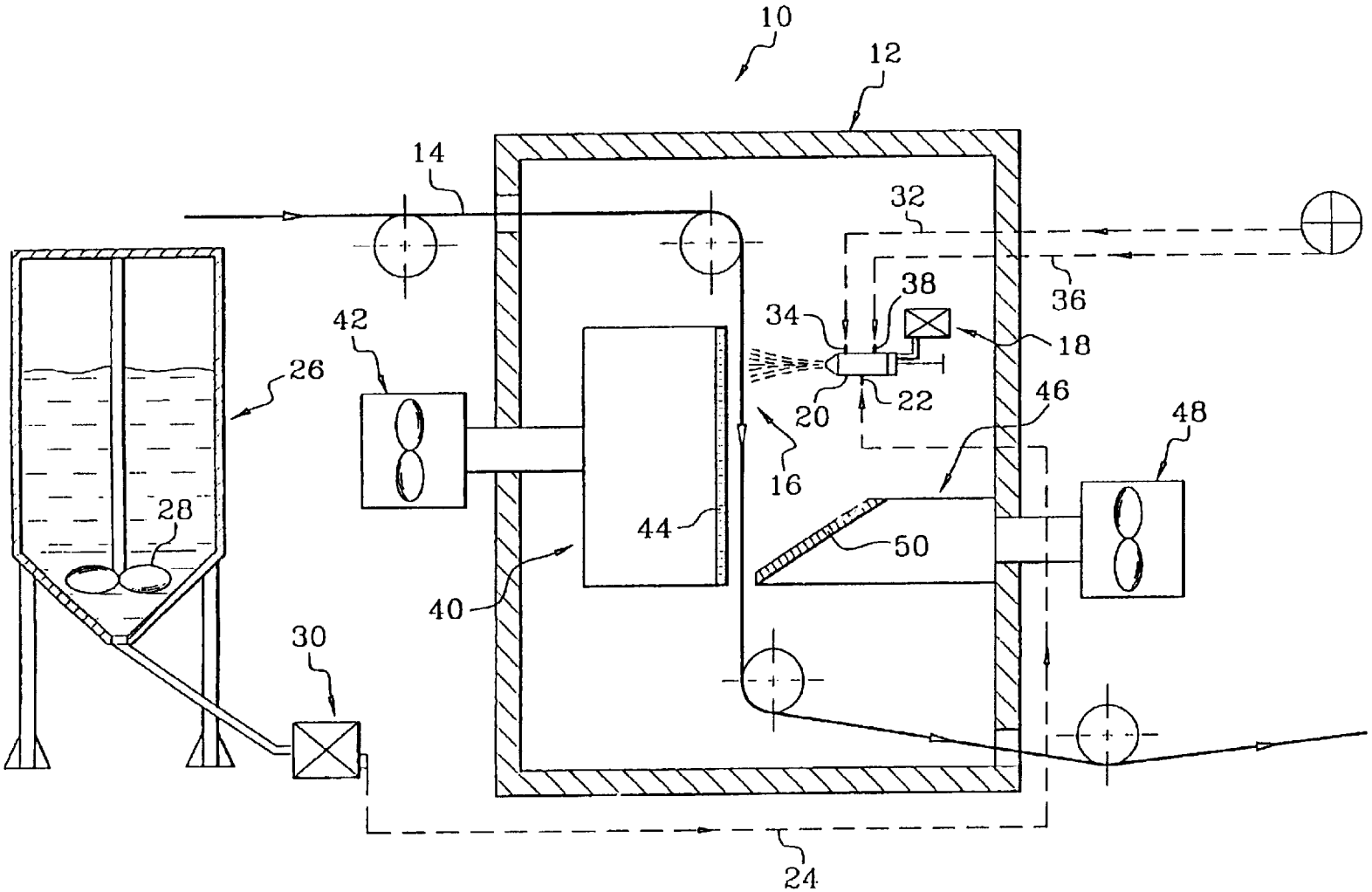
10
12
14
16
18
20
22
24
26
28
30
32
34
36
38
40
42
44
46
48
50

PROCESS FOR APPLYING A SOFTENING OR EMOLLIENT LOTION TO A PAPER PRODUCT AND PAPER PRODUCT OBTAINED ACCORDING TO THIS PROCESS

The present invention relates to a process for depositing, at room temperature, a softening lotion on an absorbent paper product.

The invention relates more particularly to a process for depositing, at room temperature, a softening or emollient lotion, which is in the liquid state at room temperature, on a product made of cellulose wadding.

The term "absorbent paper" is understood to mean the cellulose wadding obtained by a wet route or the so-called "air-laid" paper obtained by a dry route and consisting of paper fibres bound by a thermoplastic binder such as a latex.

The lotion to be deposited is of the type comprising one or more emollient active substances as a dispersion or as an emulsion in a volatile liquid vehicle, especially in water.

In general, it is desirable to be able to apply, to at least one surface of the paper product, an emollient lotion which gives the paper a soft, slippery feel.

Advantageously, the lotion can be transferred from the paper to the user's skin.

The application of the invention is in the manufacture of paper products such as papers for household or sanitary use. Mention may more particularly be made of papers whose use involves direct contact with the skin and repeated rubbing of the latter, such as disposable paper handkerchiefs, toilet paper or any other paper product intended for wiping the skin, flannels for removing make-up, dry wipes, etc.

The invention also relates to a paper product obtained according to the process.

Documents WO-A-97/30216 and WO-A-97/30217 have described examples of such aqueous compositions.

Apart from the actual composition of such an aqueous lotion, the conditions under which it is deposited on the surface of the absorbent product together with the quantity and physical state of the active substances present on the surface of the product are key factors in determining user satisfaction.

It is in fact desirable that the process used for depositing the lotion moisten the paper product, which is by nature absorbent, as little as possible so as especially to prevent the loss of mechanical properties of the product when rewinding it during the production cycle after the step of depositing the lotion and also to avoid damaging the product when storing it after it has been produced.

In order for the emollient or softening character of the product to be clearly discernible, it is desirable that the lotion and the active substances be distributed as homogeneously and as uniformly as possible over the surface of the product.

In order for the manufacturing process to be economic, it is necessary not to lose lotion, that is to say to prevent, during deposition, some lotion, and therefore some active substances, from penetrating too deeply into the paper product so as to remain in the fibrous structure and thus be "lost" from the standpoint of the emollient effect discerned by the user.

One of the other qualities of a paper product on which an emollient lotion has been deposited is the ability of the lotion present on the product, and especially the active substances that it contains, to be completely or partly transferred to the user's skin, this being so even when a small quantity of active substances has been applied to the surface of the product, something which is, moreover, desirable for the above-mentioned economic reasons, especially when this quantity is less than 3 g/m$^2$ of area of the product.

Good transferability is obtained when a process for applying a lotion which is in the solid state at room temperature, of the type mentioned in documents WO-A95/35411 or WO-A-96/24722, is used.

In all cases, it is necessary to provide means for heating the solution so that it passes from its solid state to a liquid state in which it can be applied, for example by low-pressure spraying, by coating, preferably by flexographic printing, by rotogravure or else by extrusion or by a combination of a spraying of the lotion on to a roll for transferring a film of lotion, which is then applied to the surface of the product by calendering.

Document WO-A-99/08555 cites other examples of the use of a lotion which is solid at room temperature by preheating it to above its melting point, applying it, for example, by rotogravure as spaced-apart deposits on the surface of the product and then by resolidifying the deposits of molten lotion.

In the case of an aqueous lotion which is in the liquid state at room temperature, one technique that is used is spraying by rotors.

In general, the known examples of industrial use of an aqueous lotion which is liquid at room temperature have the abovementioned drawbacks and especially the loss of product within the fibrous structure and the excessive moistening of the latter.

Document WO-A-99/19081 relates to the spray application of a composition to a material in sheet form. With regard to paper products, that document mentions (page 8, line 2 to page 9, line 8) all the problems and difficulties inherent in the absorbent nature of the paper substrate and proposes, as a solution, the rejection of the technique of spraying by atomization, making use of the prior pressurization of a mixture containing a compressed fluid.

Despite these difficulties and prejudices, the invention provides a process for depositing, at room temperature, a softening or emollient lotion on an absorbent paper product, especially cellulose wadding, which lotion is a liquid at room temperature and is of the type comprising one or more emollient active substances as a dispersion or as an emulsion in a volatile liquid vehicle, especially in water, characterized in that it consists in spraying the lotion by means of a stream of gas under pressure so as to remove at least part of the volatile liquid vehicle in order to form and spray fine droplets of lotion, having a low proportion of volatile liquid vehicle, which are deposited on at least one face of the paper product.

The technique of spraying by atomization by means of a gas under pressure, which is preferably compressed air, is used within the context of the invention in a process which is different from, or indeed contradictory to, those normally used for example in the industrial application of paints.

This is because, in the latter case, a purpose of spraying by means of a vaporizer or atomizer is to disperse the paint, which is a colour prepared with a liquid vehicle, in fine droplets which are deposited on the surface to be painted, but without drying the paint, the presence of almost all of the liquid vehicle on the surface of the product to be painted being necessary in order to obtain a homogeneous coat of paint, especially in terms of thickness, this homogeneity and the final appearance of the paint resulting from the formation of a film which stiffens by the evaporation of the liquid vehicle as the paint dries.

According to the invention, most of the liquid vehicle, especially water, is removed by vaporization.

The volatile liquid vehicle is partly extracted during the spraying step.

Preferably, an extraction booth is used so as to extract some of the vaporized liquid vehicle (water) and to remove the external contaminants.

According to the invention, the pressure of the spraying gas is greater than 2 bar and preferably greater than 4 bar.

The proportion by weight of active substance(s) in the lotion is between 1% and 50%, preferably between 20% and 50% and more particularly equal to about 30%.

The active substances are solid or semi-solid emollients, especially of the type of those described in documents WO-A-97/30216 or WO-A-97/30217.

The liquid vehicle is preferably water, but it may also be another volatile liquid vehicle such as, for example, an alcohol (methanol or ethanol), a glycol ether, etc.

Technical control of the process consists especially in optimizing the various operating parameters of a spraying plant, especially the choice of the spray nozzle, the pressure of the air and the air/lotion ratio, depending on the composition of the solution. It is also important to adjust the position and orientation of the nozzle with respect to the paper and the shape of the jet obtained, that is to say its width and its "flatness".

An illustrative example of a plant for implementing the process according to the invention will now be described with reference to the single FIGURE of the appended drawing.

As may be seen in this single FIGURE, the plant 10 comprises a stand or frame which supports certain components and devices for implementing the process for depositing the lotion on a paper sheet 14.

The sheet 14 runs continuously along the path indicated by the arrows in the FIGURE so as to travel through the spraying and deposition zone 16 vertically from the top down according to the example illustrated.

The spraying means consist of a row 18 of spray guns 20 which are placed side by side over the full width of the paper. Each gun 20 has an inlet 22 for feeding the lotion to be sprayed, the said inlet being connected via a line 24 to a tank 26 of lotion which includes a mixer 28. A feed pump 30 is interposed between the tank 26 and each gun 20, the pump having a controlled variable output.

Each gun 20 is fed with atomizing air, at a controlled variable pressure, via a line 32 connected to an air inlet 34 of the gun and with drive air via a line 36 connected to an inlet 38 of the gun 20.

The plant 10 includes extraction booths or boxes 40 placed to the rear of the paper 14 over its full width.

These extraction boxes 40 are connected to an external fan 42 in order to create suction and a partial vacuum inside them close to the spraying zone 16, the suction taking place through a filter 44.

The suction surface defined by the filter 44 and of vertical orientation is adjacent to the paper which runs vertically through the spraying zone 16.

The plant 10 also includes another suction box 46 connected to an external fan 48 and provided with a filter 50 in order to suck out the lotion which falls vertically without being deposited on the paper 14.

The invention also relates to a paper product, to at least one face of which an emollient lotion has been applied by means of the process according to the invention, characterized in that the quantity of lotion applied to the said face is equal to at least 1.5 g/m$^2$, preferably at least 2 g/m$^2$, and in that the lotion present on the said face can easily be transferred to the skin of a person using the paper product.

Examples of test results obtained by carrying out the process according to the invention will now be described, especially with reference to the three tables included at the end of the description.

Table A relates to a first series of tests carried out on a paper of the Applicant, of the "facial" type having a grammage of 45 g/m$^2$ and intended for depositing, theoretically, 2.6 g/m$^2$ of a lotion in the form of an aqueous dispersion, the viscosity of which is 380 cP and the density of which is 180 g/250 ml. The lotion was applied using a pilot machine with a full width of 42 cm and a running speed of the paper of 70 m/minute, the spray nozzles being located 40 cm from the paper sheet. This test was carried out without any extraction.

The lotion used contains 30% by weight of active substances.

The control corresponds to a paper to which no lotion has been applied.

As may be seen, the amount of water "eliminated" is very large since it is between about 40% and 60% of the total water.

Table B relates to a second series of tests carried out under the same conditions but with the intention of depositing, theoretically, 4.0 g/m$^2$ of the lotion.

It may be seen that the overall "loss" of water decreases, compared with the tests in Table A, when the amount of lotion applied increases.

The third table, Table C, below is representative of the quality of the distribution of the deposits of lotion on the surface of the paper to which the lotion was applied using the process of the invention.

The data in this table was obtained using an intentionally coloured lotion so as to reveal the deposits of lotion in the form of "spots" which can then be counted.

The three last tests in the table were carried out using the process of spraying by rotors, successively applying a theoretical amount of lotion of 1.0 g/m$^2$ (test C1), 1.4 g/m$^2$ (test C2) and 2.6 g/m$^2$ (test C3).

Tests A1 to B5 show very clearly the high degree of dimensional homogeneity of the deposits and the almost uniform distribution of these deposits on the surface, especially if these results are compared with those obtained using the process of spraying by rotors (tests C1 to C3).

TABLE A

| Gun pressure Air pressure | Measured nozzle output | Theoretical amount of lotion applied | Loss of lotion | Measured amount of lotion applied | Theoretical amount of water applied | Actual water coming from the lotion deposited | | Actual water/ theoretical water |
|---|---|---|---|---|---|---|---|---|
| in bar | g/min | g/min$^2$ | % | g/m$^2$ | g/m$^2$ | % | g/m$^2$ | % |
| 1 | 79 | 2.69 | 18.13 | 2.2 | 1.54 | 1.63 | 0.76 | −50.34 |
| 3 | 68 | 2.31 | 17.85 | 1.9 | 1.33 | 1.73 | 0.81 | −38.90 |
| 5 | 68 | 2.31 | 22.18 | 1.8 | 1.26 | 1.06 | 0.50 | −60.35 |

TABLE B

| Gun pressure Air pressure | Measured nozzle output | Theoretical amount of lotion applied | Loss of lotion | Measured amount of lotion applied | Theoretical amount of water applied | Actual water coming from the lotion deposited | | Actual water/ theoretical water |
|---|---|---|---|---|---|---|---|---|
| in bar | g/min | g/min$^2$ | % | g/m$^2$ | g/m$^2$ | % | g/m$^2$ | % |
| 1 | 164 | 5.58 | 13.95 | 4.8 | 3.36 | 4.07 | 1.91 | −43.04 |
| 3 | 134 | 4.56 | 14.43 | 3.9 | 2.73 | 4.03 | 1.89 | −30.63 |
| 5 | 141 | 4.80 | 35.36 | 3.1 | 2.17 | 2.79 | 1.31 | −39.47 |

TABLE C

| Test | DEGREE OF COVERAGE % of the area | | Number of spots per cm$^2$ | | Percentage distribution in terms of number of spots as a function of their diameter expressed in mm | | | | | | |
|---|---|---|---|---|---|---|---|---|---|---|---|
| Reference | % | ± | % | ± | 0 à 0.1 | 0.1 à 0.2 | 0.2 à 0.5 | 0.5 à 1 | 1 à 2 | 2 à 3 | 3 à 4 |
| A1 | 5.5 | 2 | 188 | 19 | 77.76 | 12.55 | 7.51 | 1.45 | 0.68 | 0.04 | 0 |
| A2 | 7.2 | 0.76 | 589 | 11 | 75.43 | 17.47 | 6.28 | 0.71 | 0.11 | 0 | 0 |
| A3 | 3.39 | 0.35 | 662 | 66 | 85.12 | 12.01 | 2.82 | 0.05 | 0 | 0 | 0 |
| A4 | 3.5 | 0.8 | 1260 | 285 | 91.91 | 7.39 | 0.7 | 0 | 0 | 0 | 0 |
| A5 | 2.91 | 0.76 | 1424 | 254 | 95.09 | 4.67 | 0.24 | 0 | 0 | 0 | 0 |
| B1 | 11.3 | 2.63 | 186 | 68 | 79.04 | 9.42 | 7.49 | 2.84 | 0.77 | 0.34 | 0.09 |
| B3 | 13.57 | 1.75 | 1196 | 173 | 78.55 | 14.6 | 6.04 | 0.77 | 0.03 | 0 | 0 |
| B5 | 6.47 | 1.8 | 2203 | 470 | 90.98 | 8.24 | 0.77 | 0 | 0 | 0 | 0 |
| C1 | 2.7 | 0.34 | 66 | 9 | 37.29 | 19.07 | 41.7 | 1.95 | 0 | 0 | 0 |
| C2 | 3.77 | 0.47 | 73 | 7 | 29.2 | 22.82 | 44.4 | 3.55 | 0.05 | 0 | 0 |
| C3 | 7.55 | 0.92 | 148 | 11 | 46.86 | 17.49 | 29.9 | 5.68 | 0.11 | 0 | 0 |

| Test | Percentage distribution in terms of area of the spots as a function of their diameter expressed in mm | | | | | | |
|---|---|---|---|---|---|---|---|
| Reference | 0 à 0.1 | 0.1 à 0.2 | 0.2 à 0.5 | 0.5 à 1 | 1 à 2 | 2 à 3 | 3 à 4 |
| A1 | 4.8 | 7 | 22.9 | 20.3 | 38.3 | 6.6 | 0 |
| A2 | 9.5 | 19.7 | 38.6 | 20 | 12.3 | 0 | 0 |
| A3 | 24.9 | 31.6 | 40.4 | 3.2 | 0 | 0 | 0 |
| A4 | 47.7 | 34.5 | 17.8 | 0 | 0 | 0 | 0 |
| A5 | 63.8 | 28.2 | 0 | 0 | 0 | 0 | 0 |
| B1 | 2.5 | 2.7 | 11.7 | 20.3 | 22.1 | 27.3 | 13.4 |
| B2 | 11.1 | 18.5 | 41.7 | 24.4 | 4.2 | 0 | 0 |
| B3 | 44.8 | 36.5 | 18.7 | 0 | 0 | 0 | 0 |
| C1 | 1.4 | 6.4 | 75.9 | 16.3 | 0 | 0 | 0 |
| C2 | 0.9 | 6.3 | 66.8 | 24.5 | 1.5 | 0 | 0 |
| C3 | 1.5 | 5.2 | 48.1 | 42 | 3.2 | 0 | 0 |

What is claimed is:

1. A process for depositing, at room temperature, a softening lotion on an absorbent paper product, which lotion is a liquid at room temperature and is of the type comprising one or more emollient active substances as a dispersion or as an emulsion in a volatile liquid vehicle, wherein the proportion by weight of the volatile liquid vehicle is at least about 50%, by directly spraying the lotion on said paper product by means of a stream of air under pressure of at least about 1 bar to about 5 bar so as to remove at least part of the volatile liquid vehicle in order to form and spray fine droplets of lotion, having a low proportion of volatile liquid vehicle, which are deposited on at least one face of the paper product.

2. The process according to claim 1, wherein the pressure of the air is about 2 bar.

3. The process according to claim 1, wherein the pressure of the air is about 3 bar.

4. The process according to claim 1, wherein the pressure of the air is about 4 bar.

5. The process according to claim 1, wherein the volatile liquid vehicle is water.

6. The process according to claim 1, wherein the volatile liquid vehicle is partly extracted during the spraying step.

7. The process according to claim 1, wherein the amount of lotion applied to the said face is equal to at least 1.5 g/m$^2$, and wherein the lotion present on the said face can be easily transferred to the skin of a person using the paper product.

* * * * *